US011131052B2

(12) United States Patent
Jeong et al.

(10) Patent No.: US 11,131,052 B2
(45) **Date of Patent: *Sep. 28, 2021**

(54) LAUNDRY TREATMENT APPARATUS

(71) Applicant: LG Electronics Inc., Seoul (KR)

(72) Inventors: Kwanwoong Jeong, Seoul (KR); Yanghwan No, Seoul (KR); Chanho Lee, Seoul (KR); Jihong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/694,667

(22) Filed: Nov. 25, 2019

(65) Prior Publication Data

US 2020/0087832 A1 Mar. 19, 2020

Related U.S. Application Data

(63) Continuation of application No. 15/197,815, filed on Jun. 30, 2016, now Pat. No. 10,487,436.

(30) Foreign Application Priority Data

Jun. 30, 2015 (KR) ..... 10-2015-0092773

(51) Int. Cl.

| | |
|---|---|
| ***D06F 39/08*** | (2006.01) |
| ***D06F 37/28*** | (2006.01) |
| *D06F 29/00* | (2006.01) |

(52) U.S. Cl.

CPC ..... *D06F 37/28* (2013.01); *D06F 39/088* (2013.01); *D06F 29/00* (2013.01)

(58) Field of Classification Search

CPC ..... D06F 21/02; D06F 21/04; D06F 21/06; D06F 21/08; D06F 21/10; D06F 21/12;

(Continued)

(56) References Cited

U.S. PATENT DOCUMENTS

| | | | |
|---|---|---|---|
| 2,254,003 | A | 8/1941 | De Marco |
| 6,351,974 | B1 | 3/2002 | Lyu et al. |

(Continued)

FOREIGN PATENT DOCUMENTS

| | | |
|---|---|---|
| CN | 1109928 | 10/1995 |
| CN | 1246552 | 3/2000 |

(Continued)

OTHER PUBLICATIONS

Machine Translation of Endo et al., JP-2010268843-A, Dec. 2010. (Year: 2010).*

(Continued)

*Primary Examiner* — David G Cormier

(74) *Attorney, Agent, or Firm* — Fish & Richardson P.C.

(57) ABSTRACT

A laundry treatment apparatus includes, a tub body configured to store water, a tub cover configured to define an upper surface of the tub body, an introduction aperture defined through the tub cover, a supply aperture provided in the tub cover, and configured to enable supply of water into the tub body, a drum that is rotatably provided in the tub body, and that is configured to receive laundry, the drum including an opening in communication with the introduction aperture, a door configured to open and close the introduction aperture, and an ejection unit configured to eject water introduced into the supply aperture to the drum, the ejection unit being configured to eject water in at least two different directions.

19 Claims, 6 Drawing Sheets

(58) Field of Classification Search
CPC ..... D06F 23/02; D06F 23/025; D06F 23/04; D06F 23/06; D06F 23/065; D06F 29/00; D06F 2103/40; D06F 2105/44; D06F 33/42; D06F 33/47; D06F 33/62; D06F 33/74; D06F 34/10; D06F 34/20; D06F 35/008; D06F 37/18; D06F 37/26; D06F 37/28; D06F 39/08; D06F 39/088; D06F 39/12; D06F 39/14
See application file for complete search history.

(56) References Cited

U.S. PATENT DOCUMENTS

| | | | | |
|---|---|---|---|---|
| 10,487,436 | B2 * | 11/2019 | Jeong ..... | D06F 39/088 |
| 2003/0061843 | A1 | 4/2003 | Ryu et al. | |
| 2005/0103063 | A1 | 5/2005 | Namkung et al. | |
| 2010/0000266 | A1 | 1/2010 | Chung et al. | |
| 2010/0064444 | A1 | 3/2010 | Nieh et al. | |
| 2011/0265524 | A1 | 11/2011 | Kim et al. | |
| 2013/0160215 | A1 | 6/2013 | Anderson et al. | |
| 2015/0114046 | A1 | 4/2015 | Jeong et al. | |

FOREIGN PATENT DOCUMENTS

| | | | |
|---|---|---|---|
| CN | 1609330 | | 4/2005 |
| CN | 101305122 | | 11/2008 |
| CN | 100519901 | C | 7/2009 |
| CN | 102115970 | | 7/2011 |
| CN | 102597355 | | 7/2012 |
| CN | 102733151 | | 10/2012 |
| CN | 102844486 | | 12/2012 |
| CN | 203212860 | | 9/2013 |
| CN | 103492627 | | 1/2014 |
| CN | 103492628 | | 1/2014 |
| CN | 203960595 | | 11/2014 |
| CN | 104562540 | | 4/2015 |
| EP | 2949803 | | 12/2015 |
| GB | 2285270 | | 7/1995 |
| JP | 2007202638 | | 8/2007 |
| JP | 2010268843 | A * | 12/2010 |
| JP | 2015085080 | | 5/2015 |
| KR | 1020020057120 | | 7/2002 |
| KR | 1020040003363 | | 1/2004 |
| KR | 1020110062459 | | 6/2011 |
| WO | 2012150539 | | 11/2012 |

OTHER PUBLICATIONS

International Search Report and Written Opinion in International Application No. PCT/KR2016/007025, dated Oct. 10, 2016, 18 pages.
Extended European Search Report issued in European Application No. 16176913.8 dated Nov. 3, 2016, 12 pages.
Taiwan Office Action in Taiwan Application No. 105118992, dated May 24, 2017, 11 pages (with English translation).
Chinese Office Action in Chinese Application No. 201610507593.X, dated Feb. 1, 2018, 17 pages (with English translation).
Office Action in Chinese Application No. 201610507593.X, dated Oct. 18, 2018, 24 pages (with English Translation).
Indian Office Action in Indian Application No. 201737002731, dated Dec. 17, 2019, 7 pages (with English translation).
Japanese Office Action in Japanese Application No. 2017-510371, dated Oct. 6, 2020, 10 pages (with English translation).

* cited by examiner

LAUNDRY TREATMENT APPARATUS

CROSS-REFERENCE TO RELATED APPLICATIONS

This application is a continuation of U.S. application Ser. No. 15/197,815, filed on Jun. 30, 2016, now allowed, which claims the benefit of Korean Patent Application No. 10-2015-0092773, filed on Jun. 30, 2015, which are hereby incorporated by reference as if fully set forth herein.

BACKGROUND

Generally, a laundry treatment apparatus is a generic term for an apparatus that washes laundry (e.g., objects to be washed or objects to be dried), an apparatus that dries laundry, and an apparatus that may perform both washing and drying of laundry.

Conventional laundry treatment apparatuses are classified into front loading type laundry treatment apparatuses which are configured such that laundry is introduced through an introduction aperture formed in the front surface of the apparatus, and top loading type laundry treatment apparatuses which are configured such that laundry is introduced through an introduction aperture formed in the upper surface of the apparatus.

A top loading type laundry treatment apparatus includes a tub having an introduction aperture formed in the upper surface of the apparatus, a drum rotatably provided inside the tub, and a door for opening and closing the introduction aperture.

Some conventional laundry treatment apparatuses having the configuration described above are devised to have a minimum volume in order to wash only a very small amount of laundry. Such a laundry treatment apparatus having a minimum volume has the feature of a very small distance between the introduction aperture and the upper end of the drum.

In addition, in the case in which the laundry treatment apparatus is an auxiliary laundry treatment apparatus that is coupled to a main laundry treatment apparatus, which performs main washing, the volume of the laundry treatment apparatus is restricted, with the result that the distance between the introduction aperture and the upper end of the drum is very small.

In addition, in the case in which the main laundry treatment apparatus is a top loading type laundry treatment apparatus, a front loading type auxiliary laundry treatment apparatus may be provided under the main laundry treatment apparatus. In this case, the auxiliary laundry treatment apparatus may be a drawer type laundry treatment apparatus, which may be configured to be discharged forward. Because the height of the auxiliary laundry treatment apparatus is less than the height of a conventional top loading type laundry treatment apparatus, the heights of the tub and the drum in the auxiliary laundry treatment apparatus are less than the heights of the tub and the drum in the conventional top loading type laundry treatment apparatus.

Therefore, impurities, which are generated inside the tub when the drum is rotated to wash laundry, remain on the door.

That is, because a water stream is generated inside the tub while the drum is rotated, there is the possibility that bubbles, which are generated as the detergent is dissolved, or contaminants discharged from the laundry during washing may remain on the door or inside the drum after the washing is completed.

When the bubbles or contaminants remain on the inner surface of the door or on the circumferential surface of the drum despite the completion of washing, a user may erroneously determine that the washing of laundry is not completed or may suspect the failure of the laundry treatment apparatus.

In addition, bubbles or impurities generated during washing of laundry may remain on the door, with the result that the bubbles or the impurities may be stuck to the laundry after the washing is completed, thereby reducing washing efficiency.

SUMMARY

According to one aspect, a laundry treatment apparatus may include a tub body configured to store water, a tub cover configured to define an upper surface of the tub body, an introduction aperture defined through the tub cover, a supply aperture provided in the tub cover, and configured to enable supply of water into the tub body, a drum that is rotatably provided in the tub body, and that is configured to receive laundry, the drum including an opening in communication with the introduction aperture, a door configured to open and close the introduction aperture, and an ejection unit configured to eject water introduced into the supply aperture to the drum, the ejection unit being configured to eject water in at least two different directions.

Implementations according to this aspect may include one or more of the following features. For example, the ejection unit may include an extension configured to surround the supply aperture, a body that is fixed to the extension, and that is spaced apart from the supply aperture by a predetermined distance, and at least two ejection holes defined through the extension and configured to discharge water introduced into the extension. The ejection unit may further include an inclined surface configured to extend upward from a surface of the body toward the ejection holes. The laundry treatment apparatus may further include a rotating shaft configured to rotate the drum, and a washing unit configured to eject at least some water moved toward the tub cover to the door using centrifugal force generated while the drum is rotated. The ejection unit may be spaced apart from a center of rotation of the drum by a predetermined distance. The washing unit may include a guide configured to extend from an edge of the tub cover toward the introduction aperture, and a discharge hole configured to discharge water supplied through the guide in a direction in which the door is located. The washing unit may further include a barrier that protrudes from the tub cover toward an upper surface of the drum, the barrier being configured to surround an edge of the introduction aperture, and the discharge hole is defined through the barrier. The door may be located above the introduction aperture, and the discharge hole is inclined so as to discharge water toward the door. The door may include a frame rotatably coupled to the tub cover and a window provided in the frame such that an inside of the tub body is visible from an outside of the tub body, and the discharge hole is inclined, and is configured to discharge water toward the window. The guide and the discharge hole may comprise at least one guide and at least one discharge hole provided at an edge of the window.

The laundry treatment apparatus may further include a cabinet, and a drawer configured to support the tub body. The laundry treatment apparatus may further include a rotating shaft configured to rotate the drum, the rotating shaft being orthogonal to a bottom surface of the tub body, where the door may include a frame rotatably coupled to the tub cover, a window provided in the frame such that an inside of the tub body is visible from an outside of the tub body, and a washing guide configured to guide at least some water moved to an edge of the frame to the window using centrifugal force generated while the drum is rotated. The ejection holes may include a first ejection hole defined through the extension, a second ejection hole spaced apart from the first ejection hole by a predetermined angle, and a third ejection hole spaced apart from the second ejection hole by a predetermined angle. The inclined surface may include a first inclined surface inclined upward from the body toward the first ejection hole, a second inclined surface inclined upward from the body toward the second ejection hole, and a third inclined surface inclined upward from the body toward the third ejection hole. The ejection unit may be spaced apart from a center of rotation of the drum by a predetermined distance. At least one of the ejection holes may be configured to eject water toward a circumferential surface of the drum. At least one of the ejection holes may be configured to eject water toward a bottom surface of the drum. The ejection unit may be located at a predetermined distance apart from a center of rotation of the drum. The ejection unit may be located at a center of rotation of the drum. The inclined surface may include a first inclined surface that is configured to incline upward from the surface of the body toward a first ejection hole, a second inclined surface that is configured to incline upward from the surface of the body toward a second ejection hole, and a third inclined surface that is configured to include upward from the surface of the body toward a third ejection hole.

DETAILED DESCRIPTION

Figure 1:
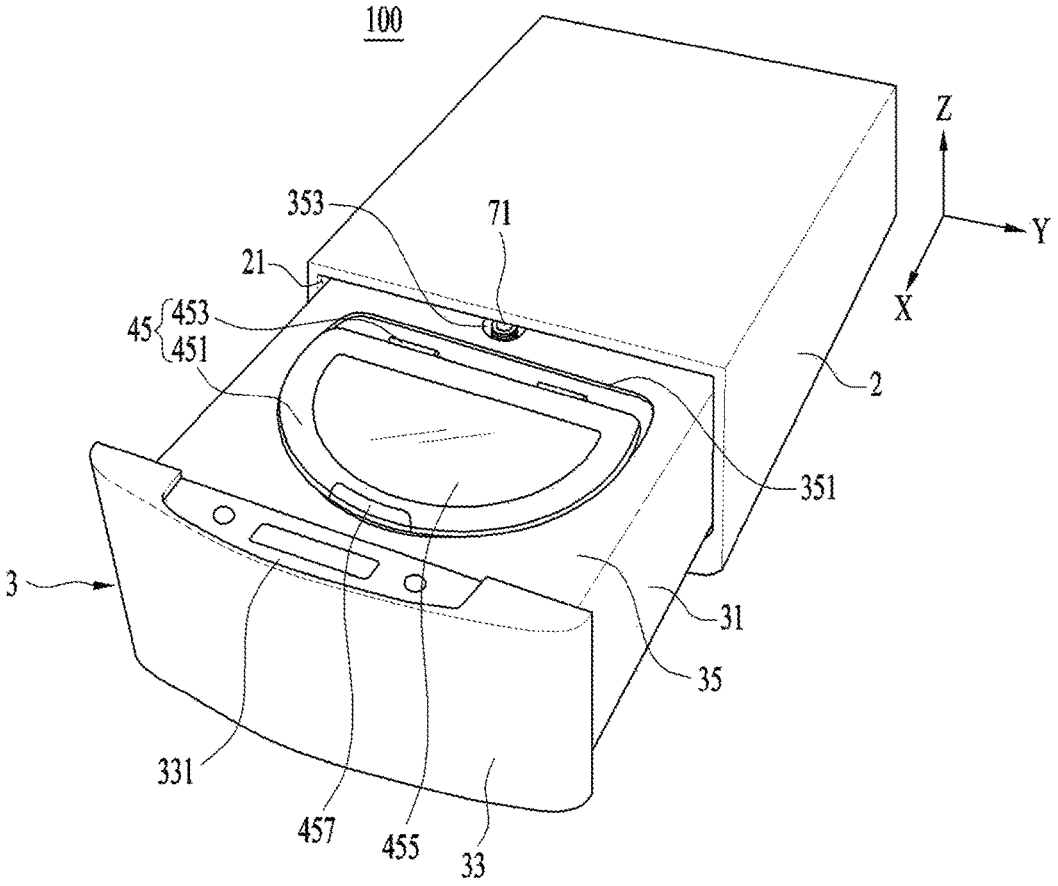
FIGS. 1 and 2 are views illustrating an example of a laundry treatment apparatus.
Figure 2:
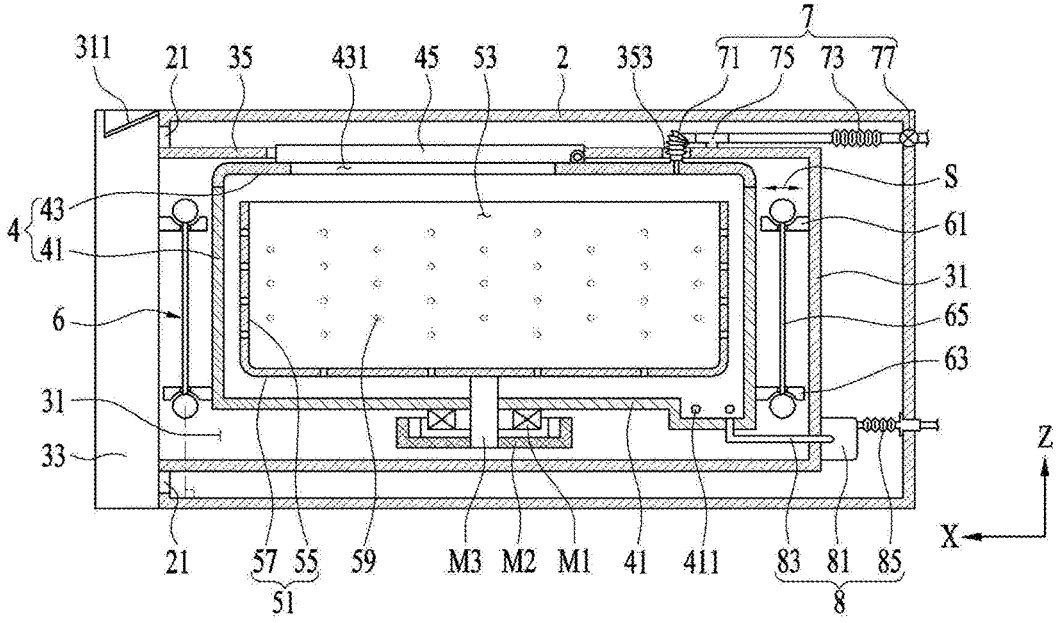

As illustrated in FIGS. 1 and 2, a laundry treatment apparatus 100 may include a cabinet 2, a drawer 3 provided to be discharged from the cabinet 2, a tub 4 provided inside the drawer 3 for storing water therein, and a drum 5 rotatably provided inside the tub 4 for storing laundry therein.

The cabinet 2 may serve to define the external appearance of the laundry treatment apparatus 100, and may also simply serve as a space in which the drawer 3 is received. In any case, the cabinet 2 may be provided in the front surface of the laundry treatment apparatus with an opening 21 for the insertion of the drawer 3.

The drawer 3 includes a drawer body 31 configured to be inserted into the inside of the cabinet 2 through the opening 21, a drawer panel 33 fixed to the front surface of the drawer body 31 for opening and closing the opening 21, and a drawer cover 35 for forming the upper surface of the drawer body 31.

The drawer panel 33 is fixed to the front surface of the drawer body 31, and the drawer panel 33 may serve as a handle for discharging the drawer body 31 from the cabinet 2.

The drawer panel 33 may be provided with a control panel 331, which is used to input a control command associated with the operation of the laundry treatment apparatus 100, and to notify a user of a message associated with the operation of the laundry treatment apparatus 100.

The drawer body 31 may have any shape so long as it can be inserted into the cabinet 2 through the opening 21 and can provide a space in which the tub 4 is received. FIG. 1 illustrates a hollow drawer body 31 having a hexahedral shape by way of example.

The drawer cover 35 has a first through-hole 351 and a second through-hole 353 for communicating the inside of the drawer body 31 with the outside. The first through-hole 351 may be provided for the introduction and discharge of laundry, and the second through-hole 353 may be provided to supply water required to wash the laundry.

As illustrated in FIG. 2, the tub 4 includes a tub body 41 located inside the drawer body 31 for storing water therein, and a tub cover 43 for forming the upper surface of the tub body 41. The tub body 41 may take the form of a cylinder having an open upper surface. A heater 411 for heating water may be provided in the tub body 41.

The tub cover 43 may have an introduction aperture 431 for communicating the inside of the tub body 41 with the outside of the tub body 41, and a supply aperture 433 for introducing water into the tub body 41.

The introduction aperture 431 may be provided under the first through-hole 351 provided in the drawer cover 35, and the supply aperture 433 may be provided under the second through-hole 353 provided in the drawer cover 35.

The introduction aperture 431 serves to allow laundry to be introduced into the tub body 41, or serves to allow the laundry inside the tub body 41 to be discharged to the outside of the tub body 41. The introduction aperture 431 is opened and closed by a door 45.

Figure 3:
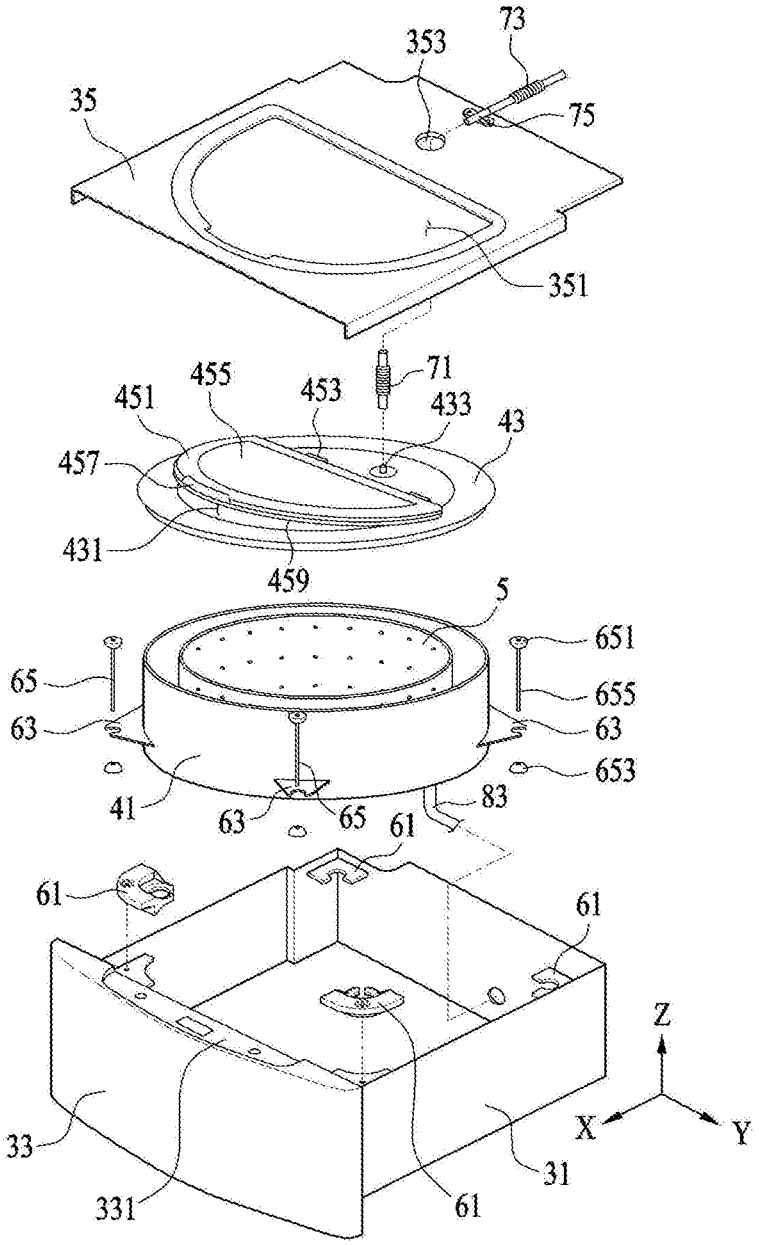
FIG. 3 is a view illustrating an example of the coupling relationship between a drawer, a tub, and a drum.

As illustrated in FIG. 3, the door 45 may include a frame 451 rotatably coupled to the tub cover 43 via a hinge 453, a window 455 provided in the frame 451, and a door handle 457 for separably coupling the frame 451 to the tub cover 43. The window 455 may be formed of a transparent material to allow the user to view the inside of the tub body 41 when the drawer 3 is discharged from the cabinet 2.

In order to prevent the water inside the tub body 41 from being discharged to the outside of the tub body 41 through the introduction aperture 431, any one of the frame 451 and the tub cover 43 may be provided with a sealing unit 459 for hermetically sealing a space between the frame 451 and the introduction aperture 431 when the door 45 closes the introduction aperture 431.

The tub 4 is coupled to the drawer body 31 via a tub support unit 6. The tub support unit 6 may include a first support member 61 provided at the drawer body 31, a second support member 63 provided at the tub body 41, and a connector 65 for connecting the first support member 61 and the second support member 63 to each other.

The connector 65 may include a first connection piece 651 configured to be seated in the first support member 61, a second connection piece 653 for supporting the second support member 63, and a bar 655 for connecting the first connection piece 651, and the second connection piece 653 to each other.

The first connection piece 651 may be shaped to be movable in the first support member 61 while being seated in the first support member 61. The second connection piece 653 may be shaped to support the second support member 63 and to be movable in the second support member 63.

As illustrated in FIG. 2 the first connection piece 651 and the second connection piece 653 may have spherical shapes. As illustrated in FIG. 3 the first connection piece 651 and the second connection piece 653 may have semispherical surfaces in contact with the respective support members 61 and 63.

The bar 655 may form a right angle with respect to the bottom surface of the cabinet 2 (i.e. may be provided parallel to the height direction Z of the cabinet 2, or provided to be orthogonal to the bottom surface of the drawer 3).

At least three tub support units 6 may be provided to couple the tub body 41 to the drawer body 31 and the bars 655 form a right angle with respect to the bottom surface of the cabinet 2, the distance between the tub cover 43 and the drawer cover 35 may be increased compared to the case where the bars 655 are tilted at a prescribed angle relative to the Z-axis.

Accordingly, the tub support units 6 may reduce the possibility of the tub cover 43 colliding with the drawer cover 35 even if the tub body 41 vibrates inside the drawer body 31.

When the bars 655 are provided to form a right angle with respect to the bottom surface of the drawer 3, at least one of the first support member 61 and the second support member 63 may be separably coupled to the drawer body 31.

When at least three tub support units 6 are provided, and both the first support member 61 and the second support member 63 are inseparable from the drawer body 31, a user who attempts to fix the tub body 41 to the drawer body 31 may firstly needs to insert the tub body 41 into the drawer body 31 to prevent the first support member 61 from interfering with the second support member 63, and thereafter may need to rotate the tub body 41 so that the second support member 63 and the first support member 61 are located on the vertical axis, in order to couple the first connection piece 651 to the first support member 61.

Although the feature by which the bar 655 of the tub support unit 6 is provided to form a right angle with respect to the bottom surface of the drawer 3 serves to minimize the distance between the outer circumferential surface of the tub body 41 and the inner circumferential surface of the drawer body 31 to minimize the volume of the laundry treatment apparatus 100, the strength of assembly of the first connection piece 651 and the first support member 61 may be deteriorated while the process described above is performed. This problem may be solved by making the first support member 61 separable from the drawer body 31.

The drum 5, which is provided inside the tub 4, may include a cylindrical drum body 51 having an opening 53 formed in the upper surface of the drum body 51. Because the opening 53 is located below the introduction aperture 431, the laundry supplied through the introduction aperture 431 may be supplied to the drum body 51 through the opening 53.

A plurality of drum through-holes 59 may be provided in the bottom surface 57 and the circumferential surface 55 of the drum body 51 for communication of the inside of the drum body 51 and the tub body 41.

The drum body 51 may be rotated inside the tub body 41 by a drive unit. The drive unit may include a stator M1 located outside the tub body 41 and may be fixed to the bottom surface of the tub body 41, a rotor M2 configured to be rotated by a rotating magnetic field provided by the stator M1, and a rotating shaft M3 penetrating the bottom surface of the tub body 41 for connecting the bottom surface 57 of the drum 5 and the rotor M2 to each other. In this case, the rotating shaft M3 may be provided so as to form a right angle with respect to the bottom surface of the tub body 41.

The laundry treatment apparatus 100 may supply water to the tub 4 via a water supply unit 7, and may discharge water stored in the tub 4 to the outside of the cabinet 2 via a drain unit 8.

As illustrated in FIG. 2, the water supply unit 7 may include a first water supply pipe 71 connected to the supply aperture 433 formed in the tub cover 43, a second water supply pipe 73 connected to a water supply source, which is located at the outside of the cabinet 2, and a connection pipe 75 fixed to the tub cover 43 for connecting the first water supply pipe 71 and the second water supply pipe 73 to each other.

The first water supply pipe 71 may connect the supply aperture 433 and the connection pipe 75 to each other through the second through-hole 353 provided in the drawer cover 35. The first water supply pipe 71 may be a corrugated pipe in order to prevent the first water supply pipe 71 from being separated from the connection pipe 75 when the tub 4 vibrates (see FIG. 3).

In addition, the second water supply pipe 73 may also be a corrugated pipe in order to prevent the second water supply pipe 73 from being separated from the connection pipe 75 when the drawer 3 is discharged from the cabinet 2. The second water supply pipe 73 may be opened and closed by a water supply valve 77, which is controlled by a controller.

In some examples, the water supply unit 7 may include a single water supply pipe for connecting a water supply source, which is located at the outside of the cabinet 2, to the supply aperture 433 provided in the tub cover 43. In this case, the water supply pipe may be a corrugated pipe.

The drain unit 8 may include a drain pump 81 fixed to the drawer body 31, a first drain pipe 83 for guiding the water inside the tub body 41 to the drain pump 81, and a second drain pipe 85 for guiding the water discharged from the drain pump 81 to the outside of the cabinet 2. In this case, the second drain pipe 85 may be a corrugated pipe.

In the laundry treatment apparatus 100 having the configuration described above, after laundry is introduced into the drum 5 and water and detergent are supplied to the tub 4, the drum 5 is rotated via the drive unit so as to wash the laundry.

The laundry treatment apparatus 100 may further include at least one of a washing unit 91 for removing impurities (bubbles, contaminants or the like) that may remain on the door 45, and may include an ejection unit 93 for restraining the generation of bubbles and washing the drum 5.

Figure 4A:
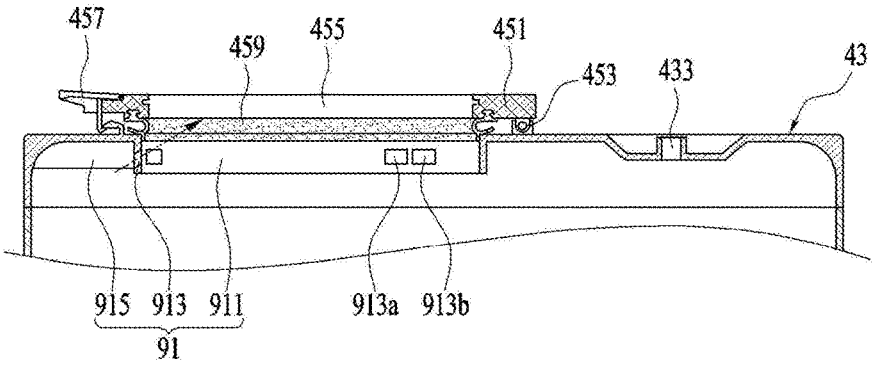
FIG. 4A and FIG. 4B are views illustrating an example of a washing unit.
Figure 4B:
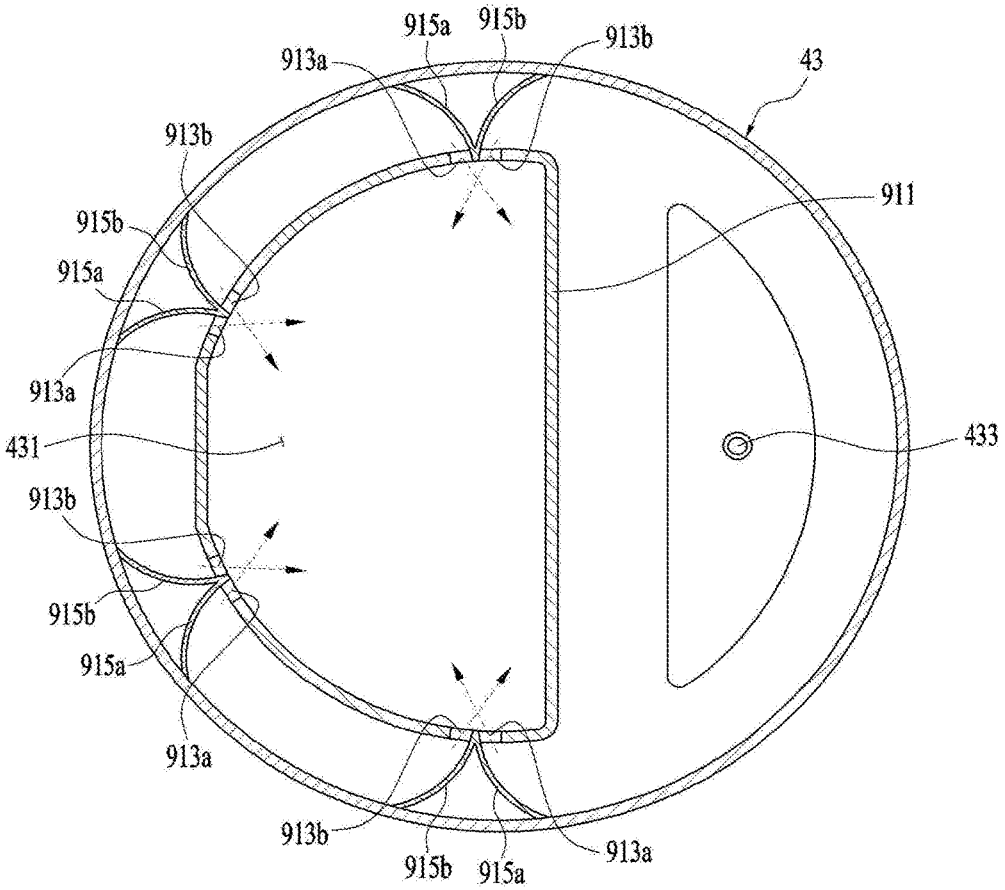

The washing unit 91 illustrated in FIG. 4A and FIG. 4B serves to wash the door 45 using the centrifugal force generated while the drum 5 is rotated.

The rotating shaft M3, which forms the center of rotation, forms a right angle with respect to the bottom surface of the tub body 41, the water inside the tub 4 is moved upward along the circumferential surface of the tub body 41 by centrifugal force while the drum 5 is rotated, and the water is then moved to the introduction aperture 431 along the tub cover 43. The washing unit 91 may discharge the water, moved to the tub cover 43 by centrifugal force, in the direction in which the door 45 is located, thereby washing the door 45.

The washing unit 91 of FIG. 4A and FIG. 4B may include a barrier 911 protruding from the tub cover 43 toward the upper surface of the drum 5, a guide 915 extending from the edge of the tub cover 43 toward the barrier 911, and a discharge hole 913 formed through the barrier 911 for the discharge of water moved along the guide 915 in the direction in which the door 45 is located.

The barrier 911 may be provided to surround the entire introduction aperture 431, as illustrated in FIG. 4B. In some examples, a plurality of barriers may be spaced apart from one another along the edge of the introduction aperture.

As illustrated in FIG. 4B the barrier 911 may protrude from the edge of the introduction aperture 431 toward the drum 5.

When the door 45 is rotatably coupled to the upper surface of the tub cover 43 so that the inner surface of the door 45 (i.e. the surface of the door 45 that is in contact with water) is located higher than the discharge hole 913, the discharge hole 913 may be inclined at a prescribed angle to allow water to be discharged toward the door 45.

In addition, when the door 45 includes the window 455 formed of a transparent material, the discharge hole 913 may be inclined to allow water to be discharged to the window 455.

The guide 915 may include a first guide 915*a* and a second guide 915*b*. The first guide 915*a* guides water, moved to the edge of the tub cover 43, to the discharge hole 913 when the drum 5 is rotated in the clockwise direction. The second guide 915*b* guides water, moved to the edge of the tub cover 43, to the discharge hole 913 when the drum 5 is rotated in the counterclockwise direction.

In the case where the discharge hole 913 is a single hole formed in the barrier 911, the respective guides 915*a* and 915*b* may guide water to the same discharge hole 913. However, in the case where the discharge hole 913 includes a first discharge hole 913*a* and a second discharge hole 913*b* formed in the barrier 911, the first guide 915*a* may guide water to the first discharge hole 913*a*, and the second guide 915*b* may guide water to the second discharge hole 913*b*.

The washing unit 91 may wash the door 45 regardless of the direction in which the drum 5 is rotated so long as the number of revolutions per minute of the drum 5 is a preset reference number of revolutions per minute (i.e. the number of revolutions per minute by which the water inside the tub body 41 is moved upward to the tub cover 43).

In addition, the respective discharge holes 913*a* and 913*b* may be inclined at a prescribed angle so that the path of water discharged from the first discharge hole 913*a* and the path of water discharged from the second discharge hole 913*b* cross each other. This may serve to increase the washing range of the washing unit 91.

The washing unit 91 may be provided in a plural number along the edge of the introduction aperture 431, and the washing units 91 may be arranged to surround the introduction aperture 431. In addition, at least two of the washing units 91 may be arranged to face each other. This may serve to increase the washing capability of the washing unit 91.

Figure 5A:
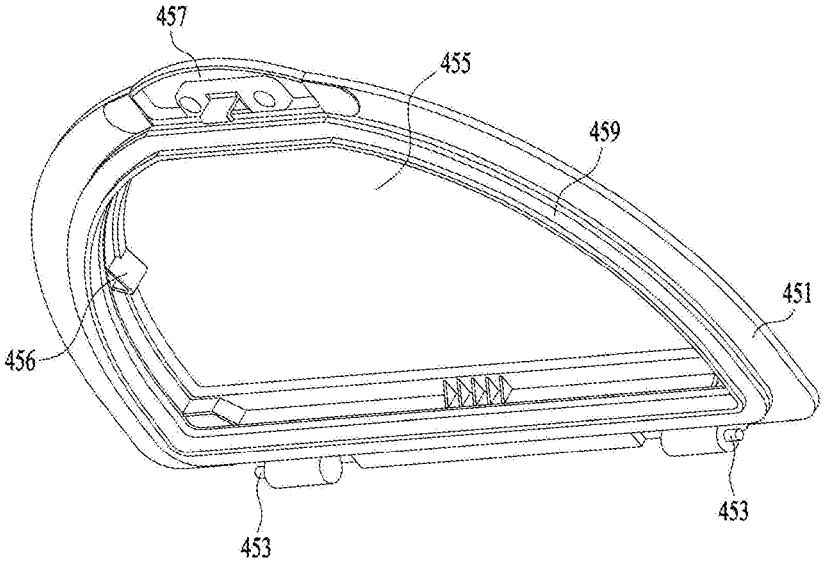
FIG. 5A and FIG. 5B are views illustrating an example of a washing guide and FIG. 6A and FIG. 6B are views illustrating an example of an ejection unit.
Figure 5B:
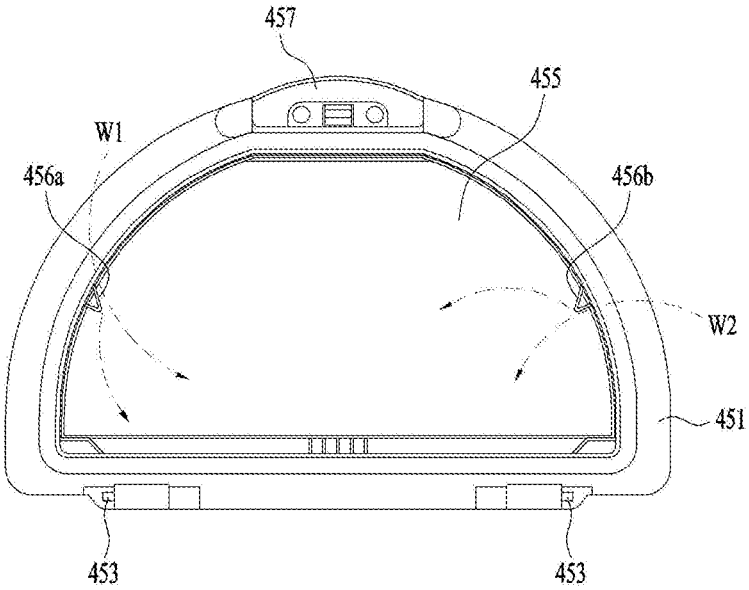

The impurities remaining on the door 45 may be removed by a washing guide 456 illustrated in FIG. 5A and FIG. 5B. The washing guide 456 may be provided at the edge of the window 455. During the rotation of the drum, water in the tub may move from the bottom surface of the tub to the edge of the frame 451 due to centrifugal force generated while the drum is rotated. The water may move around the edge of the frame 451. In the case in which the washing guide 456 is provided at the edge of the window, some of the water moved around the edge of the frame 451 may be guided toward the middle of the window 455 (W1 and W2). Consequently, it is possible to prevent the impurities from remaining on the window by the provision of the washing guide 456.

In order to maximize the washing area, the washing guide 456 may include a first washing guide 456*a* and a second washing guide 456*b* disposed so as to be center of the door 45, as illustrated in FIG. 5B.

In some examples, one of the washing unit 91 and the washing guide 456 may be provided, and in some other examples, both the washing unit 91 and the washing guide 456 may be provided.

Figure 6A:
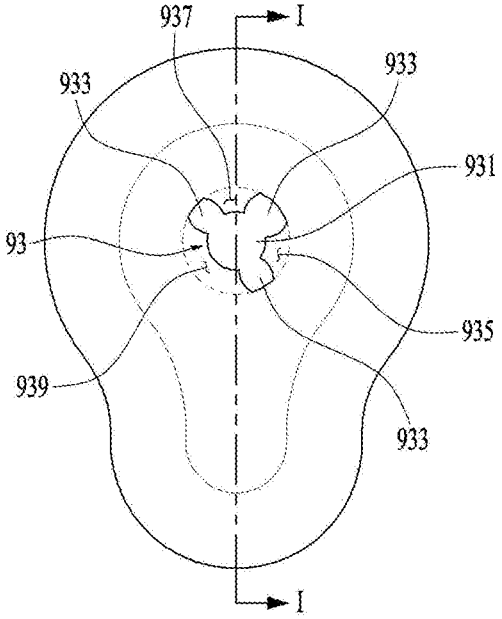
Figure 6B:
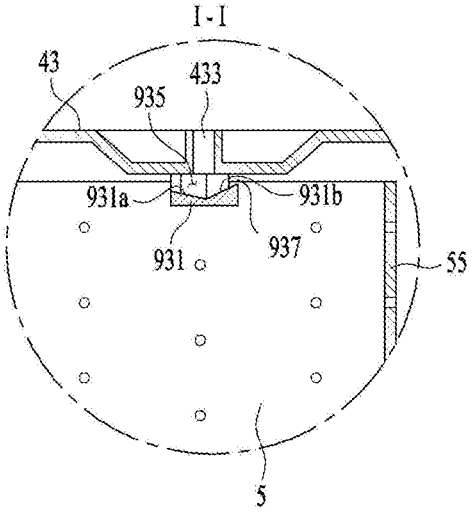

FIG. 6A and FIG. 6B illustrates one example of an ejection unit 93 for ejecting water introduced into the supply aperture 433 to the drum 5 to wash the inner circumferential surface of the drum 4 or to remove bubbles generated in the drum 5.

The ejection unit 93 may eject water in at least two different directions. As illustrated in FIG. 6, the ejection unit 93 may include an extension 933 protruding from the tub cover 43 to surround the supply aperture 433, a body 931 fixed to the extension 933 spaced apart from the supply aperture 433 by a predetermined distance, and at least two ejection holes formed through the extension 933 for discharging water introduced into the extension 933.

The ejection holes may include a first ejection hole 935, a second ejection hole 937, and a third ejection hole 939, by way of example. The respective ejection holes 935, 937, and 939 may be arranged at different intervals.

At least one of the ejection holes 935, 937, and 939 may be configured to eject water toward the circumferential surface 55 of the drum 5 in order to wash the circumferential surface of the drum 5, and at least one of the ejection holes 935, 937, and 939 may be configured to eject water toward the bottom surface of the drum 5 in order to remove bubbles generated in the drum 5.

In order to increase the pressure of water discharged from the respective ejection holes 935, 937, and 939, the body 931 may have an inclined surface, which is inclined upward toward the ejection holes 935, 937, and 939.

The inclined surface may include a first inclined surface 931*a*, which is inclined upward from the surface of the body 931 toward the first ejection hole 935, a second inclined surface 931*b*, which is inclined upward from the surface of the body 931 toward the second ejection hole 937, and a third inclined surface, which is inclined upward from the surface of the body 931 toward the third ejection hole 939.

Due to the inclined surfaces 931*a* and 931*b*, the sectional area of a flow channel, through which water moves, is gradually decreased from the center of the body 931 to the respective ejection holes 935, 937, and 939. The ejection unit 93 may increase the pressure of water discharged from the respective ejection holes 935, 937, and 939 to eject water to a distant place.

In some examples, the ejection unit 93 may be spaced apart from the center of rotation of the drum 5 by a predetermined distance. When the ejection unit 93 is located on the center of rotation of the drum 5, the ejection unit 93 may eject water to the edge of the drum 5, but it is difficult for the ejection unit 93 to eject water to center of rotation of the drum 5, which is located under the ejection unit 93.

A through hole may be formed in the body 931 to supply water to the center of rotation of the drum 5. The pressure of water discharged through the respective ejection holes 935, 937, and 939 may be reduced when the through hole is formed in the body 931.

In some examples, the ejection unit 93 may not be located on the center of rotation of the drum 5. In these examples, it is possible to supply water to the entire region of the drum 5 without a reduction in the pressure of the water ejected from the ejection unit 93.

The laundry treatment apparatus may prevent impurities, generated inside a tub during washing, from remaining on a door, which is used to open and close an introduction aperture. The laundry treatment apparatus may wash a door using centrifugal force generated by water stored in a tub while a drum is rotated, and may remove bubbles or impurities from a door when washing is completed, thereby ensuring that a user does not doubt the ability of the laundry treatment apparatus. The laundry treatment apparatus may prevent bubbles or impurities from being stuck again to laundry when the bubbles or impurities have been removed from a door, i.e. when washing is completed, thereby preventing the reduction of washing performance.

What is claimed is:

1. A laundry treatment apparatus comprising:

a tub body configured to receive water;

a tub cover defining an upper surface of the tub body and including an introduction aperture;

a drum rotatably provided in the tub body to receive laundry and defining an opening that is configured to communicate with the introduction aperture;

a door rotatably coupled to the tub cover to open and close the introduction aperture;

a guider having a wall shape, protruding from the tub cover toward the drum, and extending from an edge of the tub cover toward the introduction aperture; and a barrier that is disposed at an edge of the introduction aperture, that protrudes from the tub cover toward the drum, and that defines a discharge hole that inclines upward toward to the door.

2. The laundry treatment apparatus according to claim 1, wherein the tub cover further includes a supply aperture configured to receive water, and wherein the laundry treatment apparatus further comprises:

an ejection unit disposed at a lower surface of the tub cover, surrounding the supply aperture, and defining at least two ejection holes each facing at least two directions that are different, wherein the ejection unit is spaced apart from a center of rotation of the drum by a predetermined distance.

3. The laundry treatment apparatus according to claim 2, wherein the at least two directions include a direction toward a bottom of the drum.

4. The laundry treatment apparatus according to claim 2, wherein the at least two directions include a direction toward the door.

5. The laundry treatment apparatus according to claim 2, wherein the ejection unit protrudes from the tub cover towards the drum.

6. The laundry treatment apparatus according to claim 5, wherein the ejection unit further comprises:

an extension protruding from the tub cover towards the drum and having a shape to surround the supply aperture; and a body fixed to the extension so as to be spaced apart from the supply aperture by a predetermined distance, wherein the at least two ejection holes are provided through the extension for discharging water introduced into the extension.

7. The laundry treatment apparatus according to claim 6, wherein the ejection holes comprise a first ejection hole provided through the extension, a second ejection hole spaced apart from the first ejection hole by a first predetermined angle, and a third ejection hole spaced apart from the second ejection hole by a second predetermined angle.

8. The laundry treatment apparatus according to claim 7, wherein the ejection unit further comprises an inclined surface extending upward from a surface of the body toward the ejection holes.

9. The laundry treatment apparatus according to claim 8, wherein the inclined surface comprises a first inclined surface inclining upward from the body toward the first ejection hole, a second inclined surface inclining upward from the body toward the second ejection hole, and a third inclined surface inclining upward from the body toward the third ejection hole.

10. The laundry treatment apparatus according to claim 2, wherein the introduction aperture is configured to have a shape whose center is spaced apart from a center of rotation of the drum.

11. The laundry treatment apparatus according to claim 10, wherein the shape of the introduction aperture includes:

a straight line located in a rear region of the tub cover; and a curved line configured to connect two end points of the straight line and located in a front side of the tub cover, wherein the ejection unit is located between the straight line and a perimeter of the tub cover.

12. The laundry treatment apparatus according to claim 2, further comprising a water supply pipe configured to connect the supply aperture with a water source, wherein at least a part of the water supply pipe is a corrugated pipe.

13. The laundry treatment apparatus according to claim 2, further comprising a recess bent from the tub cover towards the drum, wherein the supply aperture is provided in the recess.

14. The laundry treatment apparatus according to claim 1, further comprising a rotating shaft configured to rotate the drum, wherein the rotating shaft is orthogonal to a bottom surface of the tub body, and the introduction aperture is parallel to the bottom surface of the tub body.

15. The laundry treatment apparatus according to claim 1, wherein a first end of the guider is connected to the edge of the tub cover and a second end of the guider is connected to the barrier.

16. The laundry treatment apparatus according to claim 1, wherein the guider comprises a first guider and a second guider, wherein the first guider and the second guider are spaced apart from each other at the edge of the tub cover and are disposed adjacent to each other at the edge of the introduction aperture.

17. The laundry treatment apparatus according to claim 16, wherein the discharge hole comprises a first discharge hole through which water guided by the first guider passes and a second discharge hole through which water guided by the second guider passes.

18. The laundry treatment apparatus according to claim 1, wherein the barrier surrounds the entire edge of the introduction aperture.

19. The laundry treatment apparatus according to claim 1, wherein the barrier comprises a plurality of barriers disposed to be spaced apart from each other along the edge of the introduction aperture.

* * * * *